United States Patent [19]

Ehrlich

[11] 4,212,090

[45] Jul. 15, 1980

[54] OTTOMAN CONVERTIBLE

[76] Inventor: Louis Ehrlich, 22 Chestnut Pl., Brookline, Mass. 02146

[21] Appl. No.: 14,369

[22] Filed: Feb. 23, 1979

Related U.S. Application Data

[63] Continuation-in-part of Ser. No. 944,075, Sep. 20, 1978.

[51] Int. Cl.[2] ..... A47C 13/00

[52] U.S. Cl. ..... 5/14; 5/17; 297/239; 297/462

[58] Field of Search ..... 5/12 R, 14, 17, 18, 5/28, 29, 37 R, 38, 42; 297/239, 440, 461, 462

[56] References Cited

U.S. PATENT DOCUMENTS

| | | | |
|---|---|---|---|
| 2,615,502 | 10/1952 | Schneider | 5/12 R |
| 3,347,186 | 10/1967 | Khattar | 297/239 |
| 3,751,739 | 8/1973 | Assmann | 5/12 R |

*Primary Examiner*—Casmir A. Nunberg

*Attorney, Agent, or Firm*—Wolf, Greenfield & Sacks

[57] ABSTRACT

An ottoman convertible having a base, lower cushion and upper cushion. As an ottoman, the lower and upper cushions are stacked on top of the base. When the unit is assembled as a bed, the upper cushion is placed directly on the base while the lower cushion rests on the floor beside the stacked base and upper cushion. In this arrangement, the top surfaces of the upper and lower cushion are coplanar. A bolster may also be provided which may serve as a back rest on the ottoman to convert it to a chair, and which may also be placed on the floor in alignment with the base and upper cushion and with the lower cushion to form an inclined head rest for the bed.

7 Claims, 6 Drawing Figures

OTTOMAN CONVERTIBLE

INTRODUCTION

This application is a continuation-in-part of my earlier filed application Ser. No. 944,075 filed Sept. 20, 1978.

This invention relates to convertible furniture and more particularly comprises a new and improved ottoman which may be converted into a bed or lounge.

Increased building costs have led to the construction of small dwelling units, and smaller dwelling units in turn have created an increased demand for convertible furniture. Most convertible furniture includes rather elaborate linkage mechanisms made of metal, that retain the various parts of the convertible furniture in special relationship to each other. Typical of such mechanisms are those found in convertible sofas which may be made into beds. Those mechanisms add very considerable weight to the furniture, making it costly to manufacture, and frequently malfunction so as to render one or the other uses of the furniture unavailable.

The principle object of the present invention is to provide a very simple convertible ottoman which is free of all linkage mechanisms and which may be very easily and quickly changed from an ottoman to a bed. The elimination of the mechanisms substantially reduces the cost of manufacture of the furniture, significantly reduces its weight, and eliminates a common source of mechanical operating problems as well as points of wear for the fabric covering of the furniture.

To accomplish that and other objects, the convertible ottoman of this invention includes among its features essentially three main parts; namely, a base, lower cushion and upper cushion. The base is in the nature of a platform having legs which support the platform above the floor. The lower cushion is an upholstered element and has a frame and legs which allow the lower cushion to stand directly on the floor. In one embodiment the platform of the base is provided with openings which receive the legs of the lower cushion so that the lower cushion may in an alternative use be stacked directly on the platform of the base. In a second embodiment, the lower cushion is provided with a recess in its bottom to receive the base when stacked on it. In both embodiments the upper cushion is also an upholstered element of the assembly, and it may be stacked either directly on the platform of the base and beside the lower cushion when the assembly is arranged as a bed, or be stacked directly on the lower cushion which in turn may be placed upon the platform of the base when the assembly is used as an ottoman. The furniture may also be supplied with a bolster which may either be placed on the upper cushion when the device is arranged as an ottoman so as to provide the ottoman with a back rest so that it may be used comfortably as a seat, or the bolster may be placed on the floor in alignment with the other elements when arranged as a bed to provide an inclined head support.

These and other objects and features of this invention will be better understood and appreciated from the following detailed description read in connection with the accompanying drawings.

BRIEF FIGURE DESCRIPTION

DETAILED DESCRIPTION

Figure 1:
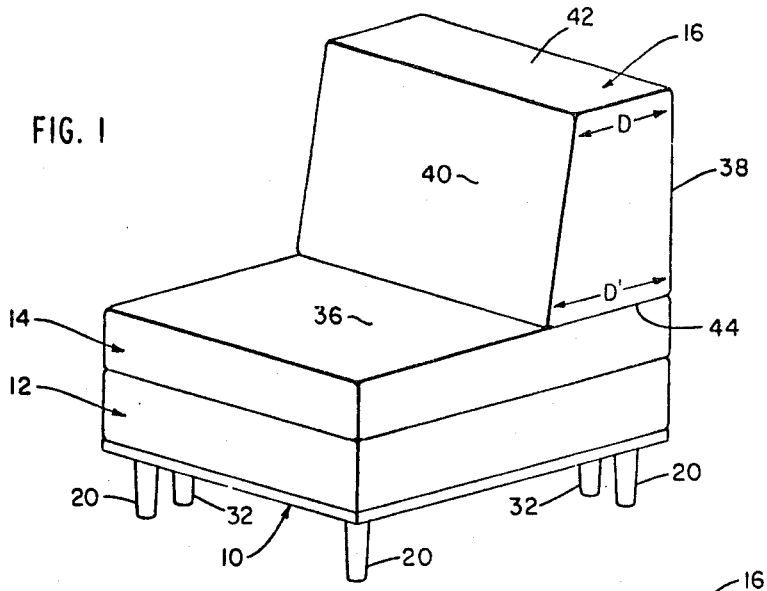
FIG. 1 is a perspective view of one embodiment of the convertible furniture of this invention assembled as an ottoman and also including a bolster-type back rest.
Figure 2:
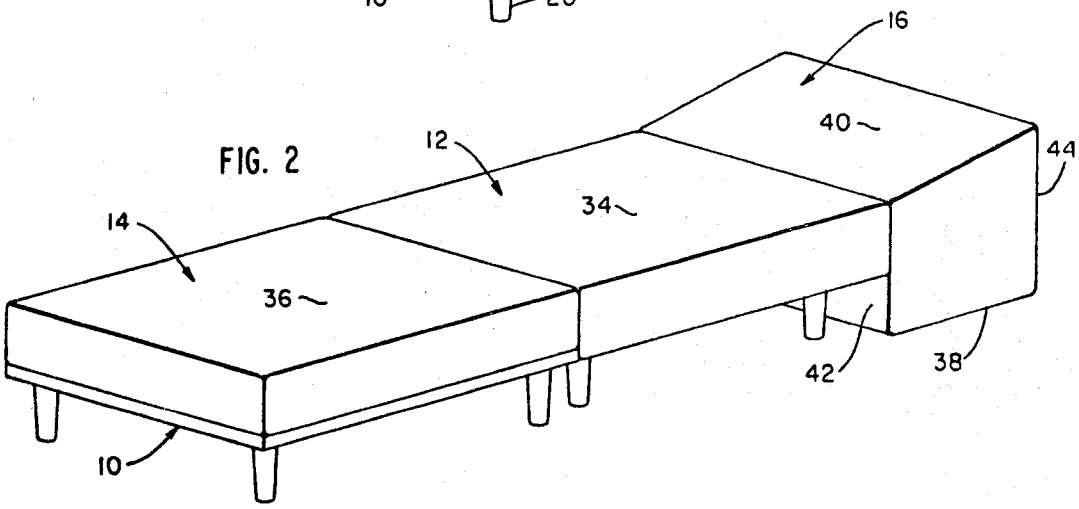
FIG. 2 is a perspective view of the convertible furniture shown in FIG. 1 but arranged as a bed.
Figure 3:
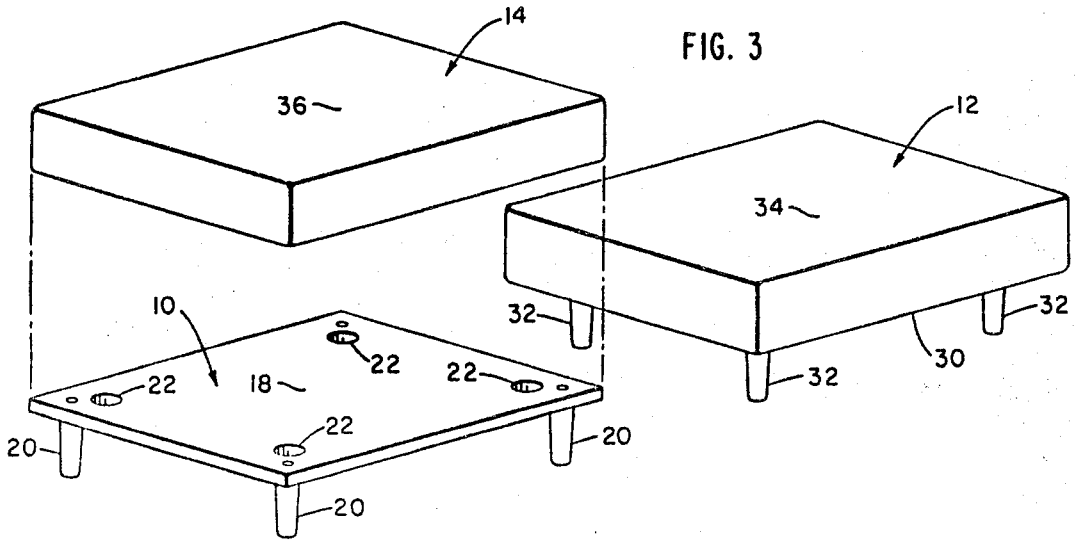
FIG. 3 is an exploded view of the base, lower cushion and upper cushion of the convertible assembly of FIGS. 1 and 2 and suggesting the manner in which the three parts are brought together to form a bed.

The convertible furniture of this invention shown in FIGS. 1–3 includes three major elements, namely, a base 10, lower cushion 12 and upper cushion 14. In addition, the assembly may include a bolster 16.

Base 10 shown separately in FIG. 3 includes a horizontal platform 18 and four tapered legs 20, one at each corner of the platform. In this embodiment, the platform 18 is also provided with four holes 22 located inwardly of the base legs 20, which holes, as described below, are designed to receive the legs of the lower cushion 12. The platform typically may be made one inch thick with a fine furniture finish on its top surface, and legs 20 typically may be four inches in height. The platform may typically be 35×29 inches, although of course all of these dimensions are merely exemplary of what may be used.

Lower cushion 12 includes a rectangular frame 30 preferably of slightly larger dimensions than platform 18, and it also has four legs 32 arranged at the four corners of the frame 30. The cushion may be 36×30 so as to slightly overlap and hide the base 10 when placed on it. Permanently secured to the frame 30 is a rectangular cushion member 34 which may be composed of a foam block appropriately upholstered with the frame to enclose and hide the frame. The cushion of course may also contain springs. Details of the interior construction of the cushion 34 form no part of the present invention. The cushion member, frame, and legs of the lower cushion may typically be four, one and four inches thick, respectively.

The upper cushion 14 is of the same rectangular plan dimension as cushion 12. Typically it may be constructed as a foam block appropriately upholstered in the same fabric as the cushion member 34. If the base and lower cushion dimensions are those suggested above, the thickness of cushion 14 should be four inches, for reasons which will become apparent presently.

In FIG. 1 the base 10, lower cushion 12 and upper cushion 14 are shown assembled on top of one another to form an ottoman. In that assembly, the lower cushion 12 is placed on the base 10 with the legs 32 extending through the openings 22 of the base so as to lie inboard of the legs 20. In this position, the legs 32 are substantially hidden by the legs of the base and the platform. The upper cushion in turn rests upon the lower cushion to form a neat two-teared assembly. While not shown, a non-slip material could be attached to the bottom surface of the upper suchion to prevent that cushion from slipping or shifting on the lower cushion when they are stacked as shown.

In FIG. 1 bolster 16 is also shown resting on the upper surface 36 of upper cushion 14. The bolster is the same length as the base 10 and cushions 12 and 14 so as to provide a back rest across the full width of the ottoman. The bolster 16 has a flat rear surface 38, an inclined front surface 40 and horizontal top and bottom surfaces 42 and 44. For reasons which are explained below, the depth D of the upper surface 42 of the bolster should be equal to the total height of the lower cushion 12 measured from surface 34 to the bottom of legs 32. To provide a comfortable slope for the back rest, the lower surface 44 should have a depth D' somewhat greater than depth D. It will be appreciated that the ottoman may be used with or without the bolster 16 as desired.

When the convertible assembly is to be used as a lounge or bed, the lower cushion 12 is removed from base 10 and placed immediately beside it with the adjacent edges of the two items engaging one another. If the base and lower cushion are square, obviously any side of the lower cushion may be placed adjacent any side of the base. If the base and lower cushion are other than square, side edges of substantially equal length should be placed against one another, i.e. 29 and 30 inches respectively.

In FIG. 2, the upper cushion 14 is shown placed directly on base 10, and when so arranged, the upper surface 35 of the upper cushion is coplanar with the upper surface 34 of the lower cushion. Consequently, the surfaces 34 and 36 provide a smooth platform which may serve very comfortable as a bed or lounge. While not shown, the assembly may also include some means to hold the base 10 next to the lower cushion 12 when the assembly is arranged as a bed in the fashion shown in FIG. 2, to prevent the two from sliding apart.

If a bolster is provided and it is desired to use it as a head rest as an extension of the bed, it may be placed directly on the floor adjacent either end of the bed assembly. Because dimension D of the upper surface 42 of the bolster is equal to the height of the lower cushion 12 measured from surface 34 to the bottom of legs 32, it will form a continuous surface with the surfaces 34 and 36. However, the surface 40 will be inclined upwardly toward side 44 of the bolster when the bolster is placed as shown in FIG. 2.

It will be evident from the foregoing description that the combined height of the upper cushion 14 and base 10 including its legs 20 and platform 18 should equal the total height of the lower cushion 12 measured from the upper surface 34 to the bottom of legs 32. If those dimensions are present, the assembly may be arranged as shown in FIG. 2 and provide a smooth uninterrupted platform for sleeping or reclining. With substantially the same plan dimensions for the base, lower cushion and upper cushion, the assembly may be arranged in a neat stack as to form an attractive ottoman.

Figure 4:
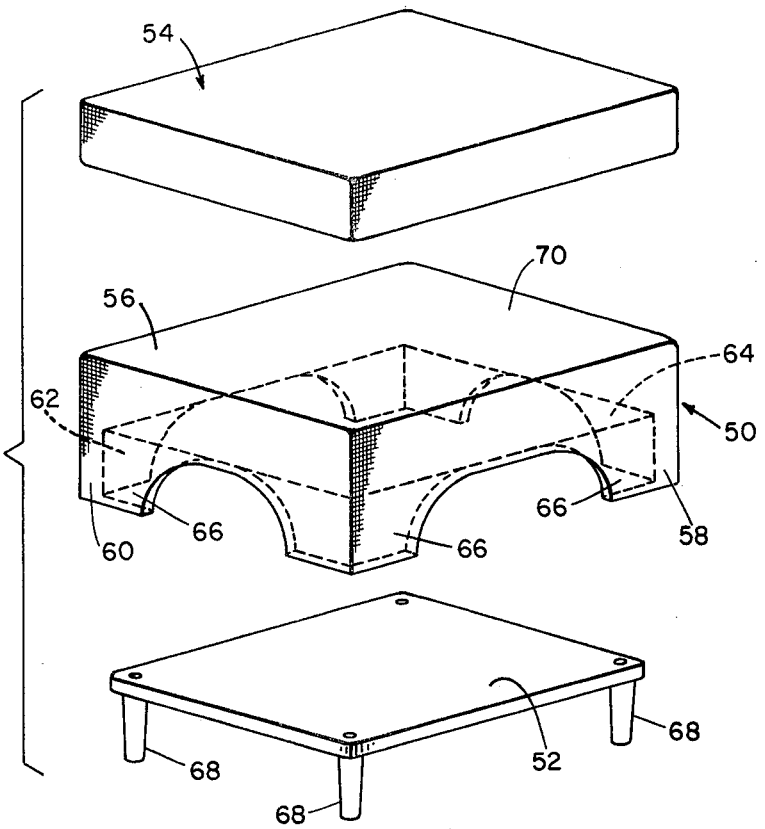
FIG. 4 is an exploded view of a second embodiment of the convertible furniture of this invention.
Figure 5:
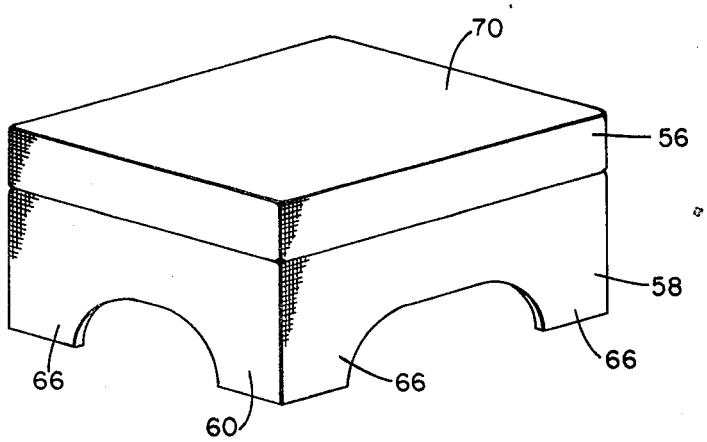
FIGS. 5 and 6 are perspective views of the convertible furniture of FIG. 4 arranged as an ottoman and bed, respectively.
Figure 6:
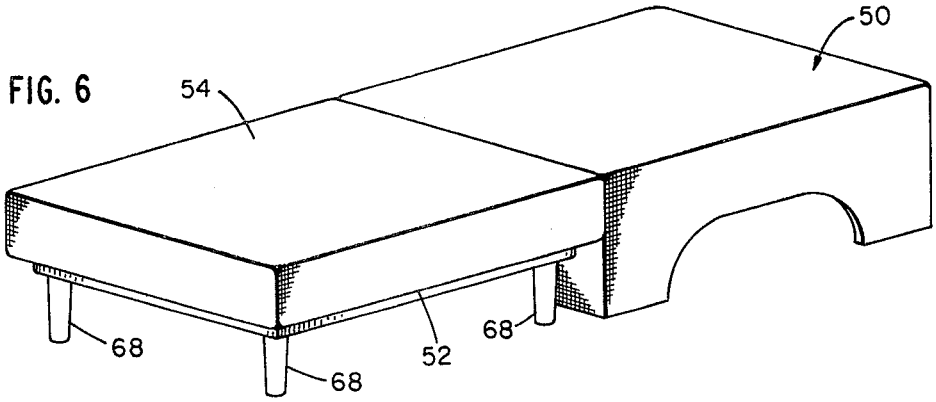

The embodiment of this invention shown in FIGS. 4–6 differs from that of FIGS. 1–3 essentially in the construction of the bottom cushion 50. The tray or base 52 and top cushion 54 are essentially the same as in the first-described embodiment.

The lower cushion 50 of this embodiment has a cushion member 56 and side members 58, 60, 62 and 64 that form legs 66 for the lower cushion at each of the four corners. The members 58–64 define a recess in the bottom of the lower cushion sized to receive the base 52 so as to hide it when the furniture is assembled as an ottoman as in FIG. 5. The legs 66 of the lower cushion enclose the legs 68 of the base 52 when the ottoman is assembled. However, when the furniture is arranged as a bed, the base 52 directly supports the upper cushion 54 and the lower cushion stands immediately adjacent the base so as to provide a continuous horizontal sleeping surface. Typically the base 52 may have overall plan dimensions of 28"×34", while the lower cushion dimensions are 30"×36". The upper cushion has the same plan dimensions as the lower cushion. As the side members 58–64 are slightly less than 1" in thickness, the base will fit within the side walls when the furniture is arranged as an ottoman. And the bottom cushion 50 may be fully upholstered from the top surface 70 to the bottom edges of the side members to enhance the appearance of the furniture. And obviously this embodiment may be used with a bolster as in the embodiment of FIGS. 1–3.

It will be appreciated that the convertible furniture of this invention may be made inexpensively and may be arranged as desired without any difficulty at all. There are no special mechanisms which either restrict the operation or which cause the fabric covering of the cushions to wear. And because there are no mechanisms, the furniture parts may be exceedingly light. Furthermore, of substantial advantage is the fact that the main sleeping surface made up of the base, lower cushion and upper cushion is raised off the floor by the legs of the base and lower cushion. (The bolster is not part of the main sleeping assembly.) It will also be recognized that when the unit is arranged in the bed configuration, the bolster may be placed along one long side to form a contemporary sofa.

Because numerous modifications may be made of this invention without departing from its spirit, I do not intend to limit the invention to the two embodiments illustrated and described. Rather, it is intended that the scope of the invention be determined by the appended claims and their equivalents.

What is claimed is:

1. An ottoman convertible to a bed comprising:

a base having a horizontal platform substantially equal in width and depth dimensions to the plan dimensions of the ottoman, said base also having legs for supporting the platform above the floor, a lower cushion having a rigid frame and with legs secured to the frame, the total height of the lower cushion from the bottom of its legs to the top surface of the cushion exceeding the height of the base from the bottom of its legs to the top surface of the platform, said platform provided with openings placed within the platform and removed from the platform edge through which openings the legs of the lower cushion extend when the lower cushion is placed on the platform, and an upper cushion having plan dimensions substantially equal to the plan dimensions of the lower cushion and designed to lie either directly on the platform or on top of the lower cushion when the lower cushion is on the platform, the plan dimensions of the base being slightly smaller than the plan dimensions of the lower and upper cushions so that when either the lower cushion or upper cushion is placed on the base, it overlays the base to hide it, the combined height of the base with its legs and the upper cushion being equal to the height of the lower cushion from its upper surface to the bottom of its legs whereby when the upper cushion is placed directly on the platform and the lower cushion is placed immediately adjacent and in alignment with the base and upper cushion, the three elements define a reclining surface having substantially twice the plan area of ottoman when the base, lower cushion and upper cushion are stacked on top of one another.

2. An ottoman convertible as defined in claim 1 further characterized by the total height of the lower cushion being approximately nine inches and the height of the upper surface of the platform measured from the bottom of the base legs being approximately five inches.

3. An ottoman convertible as defined in claim 1 further characterized by a bolster interchangeably useable on the assembled ottoman as a back rest or on the floor as a continuation of the reclining surface, said bolster being freely mounted and having an upper planar surface, said upper planar surface having a depth equal to the total height of the lower cushion.

4. An ottoman convertible to a bed comprising:

a base having a horizontal platform substantially equal in width and depth dimensions to the plan dimensions of the ottoman, said base also having legs for supporting the platform above the floor, a lower cushion having a rigid frame and with legs secured to the frame, said rigid frame having side members forming the legs of the lower cushion and said side members defining the sides of a recess in the bottom of the lower cushion to receive the base and hide it when the elements are arranged as an ottoman, said lower cushion having plan dimensions substantially equal to the plan dimensions of the platform, the total height of the lower cushion from the bottom of its legs to the top surface of the cushion exceeding the height of the base from the bottom of its legs to the top surface of the platform, means enabling the lower cushion to be placed on the platform with the legs of the lower cushion extending downwardly below the platform, and an upper cushion having plan dimensions substantially equal to the plan dimensions of the lower cushion and designed to lie either directly on the platform or on top of the lower cushion when the lower cushion is on the platform, the combined height of the base with its legs and the upper cushion being equal to the height of the lower cushion from its upper surface to the bottom of its legs whereby when the upper cushion is placed directly on the platform and the lower cushion is placed immediately adjacent and in alignment with the base and upper cushion, the three elements define a reclining surface having substantially twice the plan area of ottoman when the base, lower cushion and upper cushion are stacked on top of one another.

5. An ottoman convertible as defined in claim 4 further characterized by the plan dimensions of the base being slightly smaller than the plan dimensions of the lower and upper cushions so that when either the lower cushion or upper cushion is placed on the base, it overlays the base to hide it.

6. An ottoman convertible as defined in claim 5 further characterized by a bolster interchangeably useable on the assembled ottoman as a back rest or on the floor as a continuation of the reclining surface, said bolster being freely mounted and having an upper planar surface, said upper planar surface having a depth equal to the total height of the lower cushion.

7. An ottoman convertible to a bed comprising:

a base having a horizontal platform substantially equal in width and depth dimensions to the plan dimensions of the ottoman, said base also having legs for supporting the platform above the floor, a lower cushion having a rigid frame and with legs secured to the frame, said lower cushion having plan dimensions substantially equal to the plan dimensions of the platform, the total height of the lower cushion from the bottom of its legs to the top surface of the cushion exceeding the height of the base from the bottom of its legs to the top surface of the platform, said platform provided with openings placed within the platform and removed from the platform edge through which openings the legs of the lower cushion extend when the lower cushion is placed on the platform, and an upper cushion having plan dimensions substantially equal to the plan dimensions of the lower cushion and designed to lie either directly on the platform or on top of the lower cushion when the lower cushion is on the platform, the combined height of the base with its legs and the upper cushion being equal to the height of the lower cushion from its upper surface to the bottom of its legs whereby when the upper cushon is placed directly on the platform and the lower cushion is placed immediately adjacent and in alignment with the base and upper cushion, the three elements define a reclining surface having substantially twice the plan area of ottoman when the base, lower cushion and upper cushion are stacked on top of one another.

* * * * *